United States Patent [19]

Selby, Jr.

[11] 3,948,375

[45] Apr. 6, 1976

[54] SELF-ENFORCING PARKING SYSTEM

[76] Inventor: Clark L. Selby, Jr., 9332 Kessler Lane, Overland Park, Kans. 66212

[22] Filed: Dec. 17, 1973

[21] Appl. No.: 425,208

Related U.S. Application Data

[63] Continuation-in-part of Ser. No. 377,706, July 9, 1973, Pat. No. 3,838,760, which is a continuation-in-part of Ser. No. 190,979, Oct. 20, 1971, Pat. No. 3,757,916.

[52] U.S. Cl. ..... 194/1 R; 340/51

[51] Int. Cl.[2] ..... G07F 15/12

[58] Field of Search ..... 194/1 R, 4 R, DIG. 21, 194/DIG. 22, DIG. 23; 340/51, 38 L

[56] References Cited

UNITED STATES PATENTS

| | | | |
|---|---|---|---|
| 2,712,125 | 6/1955 | Koch | 194/1 D X |
| 3,503,480 | 3/1970 | Selby | 194/1 R |
| 3,662,157 | 5/1972 | Somers | 222/26 X |
| 3,675,204 | 7/1972 | Miehle et al. | 340/147 R |
| 3,705,976 | 12/1972 | Platzman | 340/51 X |

*Primary Examiner*—Robert B. Reeves
*Assistant Examiner*—Joseph J. Rolla
*Attorney, Agent, or Firm*—Zarley, McKee, Thomte, Voorhees & Sease

[57] ABSTRACT

A self-enforcing parking system comprising a plurality of parking stalls, each of which have a movable barrier which is movable between operative and inoperative positions. A central pay-out station is positioned remote of the stalls and has an electronic circuit incorporated therein for selectively indicating the parking charges for the respective parking stalls. The motorist drives into the stall and the barrier is moved from the inoperative position to the operative position. When the motorist desires to leave the parking stall, he goes to the central pay-out station where he dials his stall identification number. The meter associated with the pay-out station indicates the monetary amount corresponding to the length of time the vehicle has been positioned in the stall. The motorist must deposit the proper amount of coins in the meter to cause the barrier to be lowered.

1 Claim, 5 Drawing Figures

SELF-ENFORCING PARKING SYSTEM

BACKGROUND OF THE INVENTION

This application is a Continuation-In-Part application of the application, Ser. No. 377,706, filed July 9, 1973, now U.S. Pat. No. 3,838,760; which is a Continuation-In-Part of Ser. No. 190,979, filed Oct. 20, 1971, now U.S. Pat. No. 3,757,916.

This invention relates to a self-enforcing parking system and more particularly to a system wherein a central pay-out station is electrically connected to a plurality of parking stalls so that a single station may serve a plurality of the stalls.

Conventional parking systems are generally unsatisfactory due to the fact that persons can park in parking spaces utilizing parking meters without depositing money into the meters. The biggest disadvantage in available parking is in the private parking area such as a parking lot having a large number of parking spaces. These areas generally do not come under police jurisdiction since they are for private management. Thus, if parking meters are provided in the parking lot, the drivers sometimes attempt to avoid depositing money in the parking meters since they realize that a ticket for a parking violation will not be issued. The solution to the above problem has been to provide attendants at the parking areas to collect the money for the parking charges. Obviously, such a solution is less than desirable due to the costs and administrative details associated therewith.

One means of eliminating the problems enumerated above was disclosed in applicant's earlier U.S. Pat. No. 3,503,480 which issued Mar. 31, 1970. A further means of eliminating the problems enumerated above was disclosed in applicant's earlier U.S. Pat. No. 3,757,916 which issued Sept. 11, 1973. The instant invention represents a significant advance in the earlier devices since the system may be more economically installed due to the fact that a single central pay-out station serves each of the stalls. In the previous devices, a parking meter was provided adjacent each of the parking stalls which substantially increased the cost as compared to the instant system. Thus, the instant invention represents a significant advance in the earlier devices.

Therefore, it is a principal object of the invention to provide a method and means of self-enforcing parking.

A further object of the invention is to provide a means for parking a vehicle utilizing a single central pay-out station wherein the driver pays for the time the vehicle was in the parking space.

A further object of this invention is to provide a self-enforcing type of parking system.

A further object of the invention is to provide a parking system which prevents the vehicle from being removed from the parking space until a predetermined amount of money has been inserted into a parking meter apparatus.

A further object of this invention is to provide a parking system which eliminates the need for the driver to insert money into the parking meter in advance.

A further object of the invention is to provide a self-enforcing parking system which eliminates the need of a person being in attendance in a parking lot.

A further object of the invention is to provide a self-enforcing system which is economical of manufacture, durable in use and refined in appearance.

These and other objects will be apparent to those skilled in the art.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENT

Figure 1:
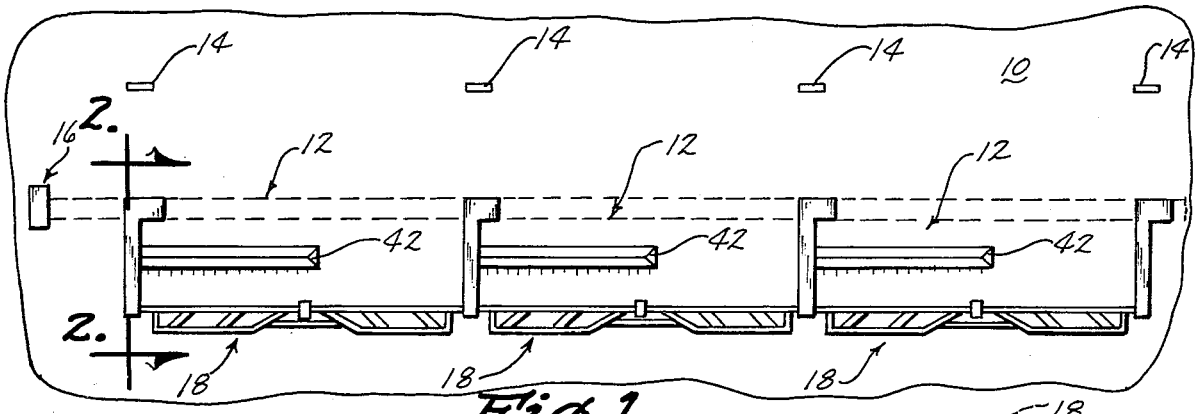
FIG. 1 is a partial top plan view of the parking system of this invention.
Figure 3:
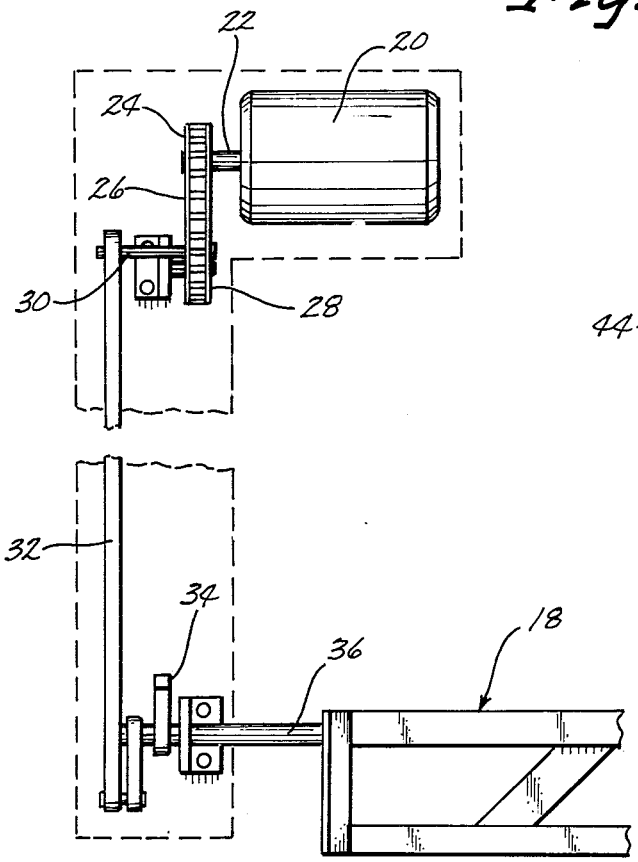
FIG. 3 is a partial top plan view of the housing and barrier.

In FIG. 1, the numeral 10 refers generally to a parking area having a plurality of parking stalls 12 provided thereon. Each of the parking stalls 12 has an identification post 14 or the like positioned forwardly of the respective stall so that the motorist can determine the number of the particular stall in which he is parked. The numeral 16 refers generally to a central pay station in the form of a parking meter as seen in FIG. 3.

Figure 2:
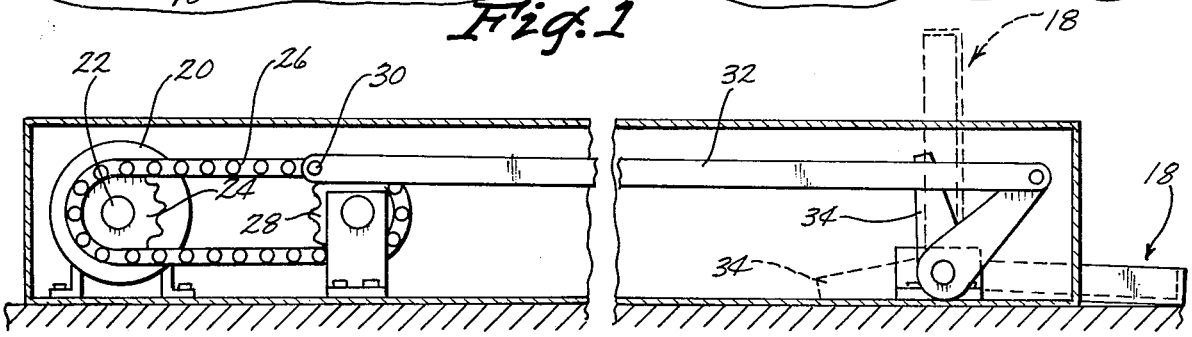
FIG. 2 is a side view of the parking barrier and the means for operating the same with portions of the housing cut-away.

Each of the parking stalls 12 comprise a barrier means 18 and means for moving the same between an inoperative horizontal position and an operative vertically disposed position. In FIG. 3, the numeral 20 refers to an electric gear motor having a drive shaft 22 rotatably extending therefrom which has a sprocket 24 mounted thereon. Chain 26 extends around sprocket 24 and extends around a sprocket 28 suitably rotatably mounted. A bolt 30 is mounted on the chain 26 for movement therewith. A connecting arm 32 is connected to the outer end of the bolt 30 and extends rearwardly therefrom. The rearward end of the connecting arm 32 is pivotally connected to a shaft bracket 34 which is rigidly connected to the outer end of a barrier shaft 36. Thus, activation of the gear motor 20 in one direction will cause the barrier 18 to be raised to the operative position illustrated by broken lines in FIG. 2 with activation of the gear motor in an opposite direction causing the barrier 18 to be lowered to the inoperative horizontal position. The means for operating the barrier are substantially identical to that disclosed in application, Ser. No. 377,706, now U.S. Pat. No. 3,838,760. The primary difference in the apparatus for raising and lowering the barrier disclosed herein is that a bolt 30 is connected to the chain rather than the connecting arm being directly connected to the sprocket 28. A limit switch 38 (not shown in FIG. 2) is also provided as in the co-pending application so that the gear motor will be powered down upon the closing of the limit switch as will be described in more detail hereinafter.

Figure 4:
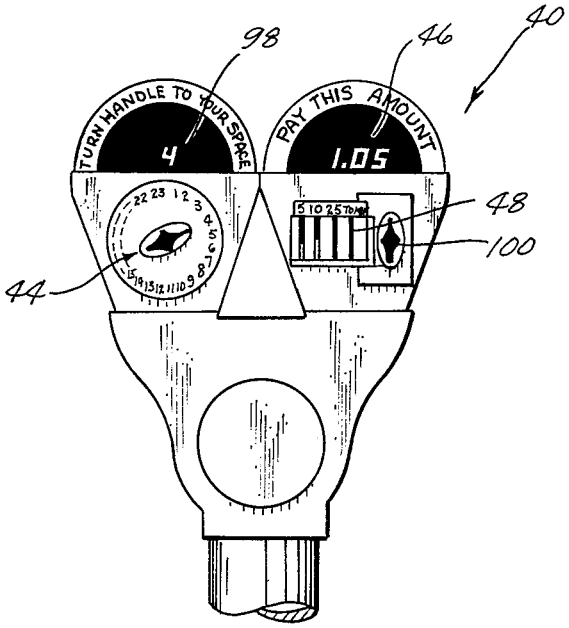
FIG. 4 is a front view of the parking meter.
Figure 5:
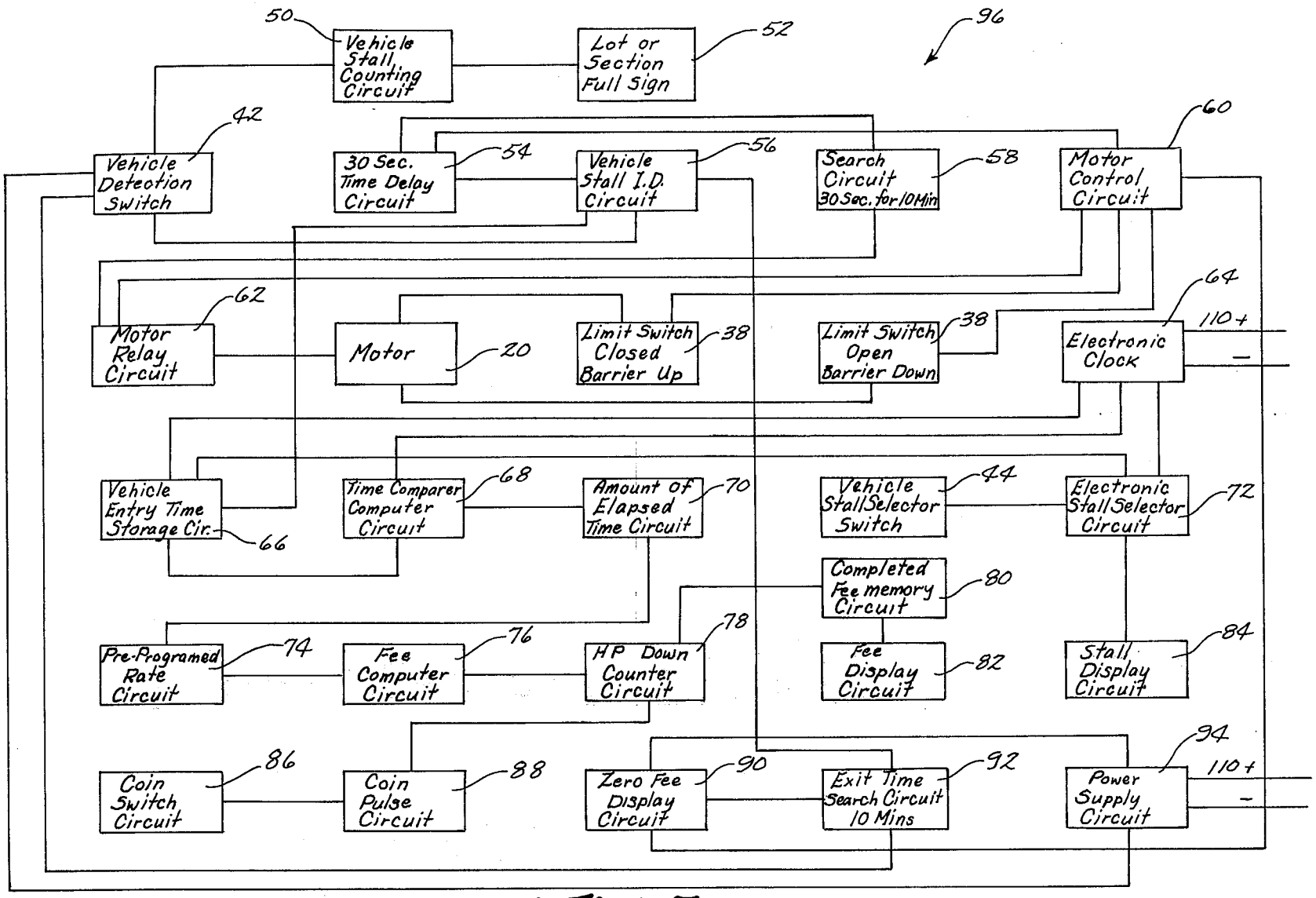
FIG. 5 is a block diagram illustrating the circuitry of the invention.

The numeral 40 refers generally to the parking meter apparatus which is provided at the central pay station and which is electrically connected to the pressure switches 49 at least of the parking stalls and which is electrically connected to the gear motors and limit switches at each of the stalls. Meter 40 generally comprises a dial means 44 to enable the motorist to dial the particular stall number in which he is parked so that the parking charges for that particular stall will be indicated on a re-out referred to generally by the reference numeral 46. The meter 40 also includes a coin slot apparatus for inserting the proper monetary amount corresponding to the monetary amount depicted on the re-out 46. The electrical circuitry of the meter 40 is depicted generally in block diagram form in FIG. 4. The circuitry of the meter is either conventional in design or is fully disclosed in the U.S. Pat. No. 3,757,916 which issued Sept. 11, 1973.

To enable a more complete understanding of the operation of the system, the following chart identifies the components of the operating mechanism:

50 Vehicle stall counting circuit
52 Lot or section full sign
54 30 second time delay circuit
56 Vehicle stall identification circuit
58 Search circuit (30 seconds for 10 minutes)
60 Motor control circuit
62 Motor relay circuit
64 Electronic clock
66 Vehcile entry time storage circuit
68 Time comparer computer circuit
70 Amount of elapsed time circuit
72 Electronic stall selector circuit
74 Pre-programmed rate circuit
76 Fee computer circuit
78 Up-down counter circuit
80 Computed fee memory circuit
82 Fee display circuit
84 Stall display circuit
86 Coin switch circuit
88 Coin pulse circuit
90 Zero fee display circuit
92 Exit time search circuit (10 minutes)
94 Power supply circuit When one of the parking stalls is empty, the normal method of operation is as follows. The vehicle enters the parking stall 12 which causes the vehicle detection switch 42 to be closed or made. A signal is signal is sent from the vehicle detection switch 42 to the electronic control circuit referred to generally by the reference numeral 96. Electronic control circuit 96 generally includes all of the circuitry except the motor control circuit 60, limit switch 38, gear motor 20 and motor relay circuit 62. Upon a signal being sent from the detection switch 42 the electronic control circuit, a 30 second time delay 54 is activated. At the end of the 30 second time delay, a signal is sent to the motor control circuit 60. The purpose of the 30 second time delay circuit 54 is to prevent the apparatus from being activated upon a person stepping on the vehicle detection switch 42. In other words, the vehicle detection switch 42 must be made or closed for at least a 30 second period so that the time delay circuit 54 will send a signal to the motor control circuit 60.

The motor control circuit 60 then energizes the motor relay circuit 62 which activates the motor 20. Activation of the motor 20 causes the shaft 22 and sprocket 24 to be rotated so that the connecting arm 32 is moved forwardly to cause the barrier 18 to be raised upwardly behind the front wheels of the vehicle. When the barrier 18 has been raised to its vertical position, the chain bolt 30 strikes the limit switch 38 to close the same. As the limit switch 38 is closed, a signal is sent to the motor control circuit 60 which causes the gear motor 20 to be powered down or shut-off. It should be noted that a detection switch search circuit 58 is also activated at the end of the 30 second time delay sensed by the circuit 54. When the detection switch search circuit 58 is activated, it begins to check to see if the vehicle detection switch 42 is made every 30 seconds for the next 10 minutes. If the vehicle detection switch 42 is opened during the operation of the search circuit 58, a signal is sent to the motor control circuit 60 to lower the barrier 18 to its horizontal position and to clear the vehicle entry time from the vehicle entry time and stall identification circuit. Additionally, at the end of the thirty second time delay, a signal is sent to the vehicle entry time storage circuit 66 and stall identification circuit 56. The vehicle entry time storage circuit and stall identification circuit records the vehcile stall number and time of the vehicle entry into that stall. The entry time is recorded from the electronic clock 64 which is operational at all times.

When the motorist desires to leave the parking stall, he goes to the central pay station 16 where he rotates the dial 44 to the number corresponding to his parking stall identification. As switch 44 is rotated by the motorist to his parking stall number, there appears a display 98 illustrating his parking stall number in the window area in the left hand side of the meter. Display 98 would be of the sperry type or other gas operated displays, incandescent displays, light emitting diodes type displays, or a liquid crystal type display. When the stall number has been selected by the motorist, the time comparator computer circuit 68 obtains the current time from the clock circuit and would recall the vehicle entry time from the vehicle stall identification circuit 56 and the vehicle entry time storage circuit 66. The difference between the current time and the entry time establishes the amount of elapsed time with the elapsed time information being sent to a pre-programmed rate circuit 74 which computes the parking fee. The computed parking fee is relayed to the up-down counter circuit 78 which sends this amount to the computed fee memory circuit 76. The computed fee memory circuit 76 sends a signal to the display circuit 82 with the fee then being displayed in the right side window of the parking meter. The type of fee display is of the types previous mentioned which are suitable of use in the vehicle display stall unit.

The fee display displays to the motorist the amount of the parking charges. The motorist then inserts a combination of coins or tokens to pay his parking fee. As the motorist places his coins into the coin slot apparatus 48, they fall into a coin carrier. As the motorist turns the operating handle 100, the coins are rotated around the coin carrier until they strike a coin segment which would cause a wiping paw to be extended. If tokens are used, a token could be given a value of 1 dollar or the like or the amount could be preprogrammed for a higher or lower value. The amount could also be preprogrammed for a complete zero setting so that the token would strike the first coin or token switch as the token was being rotated in the coin carrier by the motorist turning the operating handle. As the first switch is closed, a predetermined number of count pulses (each equaling 5 cents) would be sent to the up-down counter circuit 78. If the token had a 1 dollar value, the first switch would equal 15 pulses. The 15 pulses would be substracted from the up-down counter circuit 68 and the computed fee memory circuit 80 with the substracted amount being indicated on the fee display. As the handle continues to be rotated with a token in the coin carrier, the wiping paw strikes the second or the quarter switch which could then be closed so that a signal is sent to substract three pulses from the up-down counter and the computed fee memory circuit together with the fee display unit.

As the handle continues to be rotated by the motorist, the wiping paw strikes the third switch (the ten switch) and the fourth switch (the nickel switch). Each of the third and fourth switches causes one pulse to be substracted from the up-down counter and the computed fee circuit as well as the fee display unit. If the motorist found it necessary to leave the meter in the event that he did not have enough change to reduce the display down to zero, he could select his parking stall number upon his return and the fee computing cycle would re-activate itself to compute his parking charges. The electronic stall selector circuit 72 would recall the vehicle entry time from the vehicle entry time storage circuit 66 and the stall identification circuit 56. The vehicle entry time storage circuit and the stall identification circuit send a signal to the time comparator computer circuit 68 which obtains the current time from the electronic clock circuit to determine the amount of elapsed time. The amount of elapsed time information is sent to the pre-programmed rate circuit 74 which would allow the fee computer circuit 76 to compute the fee with the information being relayed to the up-down counter circuit 78. A signal is then sent to the computed fee memory circuit 68 which gives credit for the payment that the motorist previously paid and would substract the credit amount from the present parking fee. The remaining charges are then indicated on the fee display circuit.

When sufficient coins or tokens have been deposited into the parking meter to cause the up-down counter to be at zero and the display indicator to be at zero, a signal is sent to the motor control circuit which then energizes the motor relay circuit 62. Upon the motor relay circuit 62 being energized, the gear motor 20 begins to run so that the barrier is returned from its vertical position to its horizontal position. The gear motor drives the chain and the connecting arm mechanism until the chain bolt closes a limit switch upon the barrier reaching its horizontal position. When the limit switch closes, it sends a signal to the motor control circuit 60 to power down the motor relay circuit 62 which stops the motor 20.

The motorist is then given a predetermined amount of time to remove his vehicle from the stall after his fee has been paid. When the display unit is reduced to zero, a signal is sent to the exit time search circuit 92 which when energized checks the vehicle stall number and then continues to check the vehicle stall for the next 5 to 10 minutes to determine if the vehicle detection switch is opened or closed. If the motorist removes his car from the parking stall and the vehicle detection switch 42 is released, then the electronic control unit is shut down. If the vehicle remains in the parking stall after the predetermined time, the entire cycle is restarted which locks the vehicle into the parking stall since the barrier will again be raised. The parking system disclosed herein is also provided with a stall counting circuit 50 which would be pre-set corresponding to the number of stalls on the parking lot. The vehicle stall counting circuit 50 is activated when the vehicle detection switch 42 is closed which would also light a lot or section full sign.

The pre-programmed rate circuit enables a rate to be programmed for three different time and rate periods with a fourth amount programmed for a maximum daily rate so that, when the parking fees have advanced to this amount, no further charges would be advanced until 24 hours after the vehicle had entered the parking stall which would then cause the program to begin again.

Thus it can be seen that a self-enforcing parking system has been described wherein a signal central pay station has been provided for all of the parking meters in the parking lot. The fact that a single meter is provided for several parking stalls eliminates the need for a parking meter at each of the parking stalls as was necessary in applicant's previous devices. The elimination of parking meters at each of the stalls greatly reduces the cost of installation which results in considerable economy. Thus it can be seen that the system accomplishes at least all of its stated objectives.

I claim:

1. A self-enforcing parking system, comprising, a plurality of parking stalls, each of said stalls having a movable barrier means movable between first and second positions, each of said stalls having a vehicle detection switch means which is operable when a vehicle enters the stall, a central pay-out station remote from said stalls, said central pay-out station, comprising electronic means for indicating parking charges for the respective parking stalls, said central pay-out station also comprising coin receiving means which reduces the indicated parking charges corresponding to the monetary amount received thereby, circuit means electrically connecting each of said vehicle detection switches to said central pay-out station so that the barrier means is moved to its second position after the vehicle has entered the parking stall, said central pay-out station also comprising means for lowering the barrier means when the proper monetary amount has been inserted to bring the indicated parking charges to zero, said central pay-out station having a dial means thereon with indicia provided which corresponds to the various parking stalls so that the motorist can dial the proper stall identification for indicating the parking charges to be paid.

* * * * *